US010923065B2

(12) United States Patent
Wang et al.

(10) Patent No.: US 10,923,065 B2
(45) Date of Patent: Feb. 16, 2021

(54) DATA SIGNAL DELAY CIRCUIT, DELAY METHOD AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Mingming Wang, Beijing (CN); Wei Sun, Beijing (CN); Ming Chen, Beijing (CN); Xue Dong, Beijing (CN); Wenchao Han, Beijing (CN); Rui Liu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/555,063

(22) Filed: Aug. 29, 2019

(65) Prior Publication Data

US 2020/0294462 A1 Sep. 17, 2020

(30) Foreign Application Priority Data

Mar. 15, 2019 (CN) ..... 2019 1 0195996

(51) Int. Cl.
*G09G 3/36* (2006.01)

(52) U.S. Cl.
CPC ..... *G09G 3/3677* (2013.01); *G09G 3/3688* (2013.01); *G09G 2310/066* (2013.01); *G09G 2310/08* (2013.01); *G09G 2320/0223* (2013.01)

(58) Field of Classification Search
CPC ..... G09G 3/3677; G09G 3/3688; G09G 2310/066; G09G 2310/08; G09G 2320/0223
See application file for complete search history.

(56) References Cited

U.S. PATENT DOCUMENTS

2008/0170024 A1* 7/2008 Song ..... G09G 3/3648 345/96
2009/0109197 A1* 4/2009 Tu ..... G09G 3/3674 345/204

* cited by examiner

*Primary Examiner* — Mihir K Rayan
(74) *Attorney, Agent, or Firm* — Kinney & Lange, P.A.

(57) ABSTRACT

A data signal delay circuit and delay method and a display device are disclosed. The data signal delay circuit includes a feedback signal generation sub-circuit, a compensation signal generation sub-circuit, and a control sub-circuit. The feedback signal generation sub-circuit is configured to generate a feedback signal based on a first level signal from the first level signal terminal and a second level signal from the second level signal terminal under the control of a gate drive signal from a scan signal line currently being scanned. The compensation signal generation sub-circuit is configured to generate a compensation signal based on the feedback signal and a data enable signal from the data enable signal line. The control sub-circuit is configured to delay a data enable signal of the data enable signal line in a next cycle based on the compensation signal.

18 Claims, 8 Drawing Sheets

DATA SIGNAL DELAY CIRCUIT, DELAY METHOD AND DISPLAY DEVICE

CROSS-REFERENCE TO RELATED APPLICATION(S)

This application claims priority to Chinese Patent Application No. 201910195996.9, filed on Mar. 15, 2019, and entitled "Data signal delay circuit, delay method and display device," the entire disclosure of which is incorporated herein by reference.

TECHNICAL FIELD

The present disclosure relates to the field of display technologies, and in particular, to a data signal delay circuit, a delay method, and a display device.

BACKGROUND

A Gate Driver On Array (GOA) on a display panel (for example, a liquid crystal display LCD) generates a gate drive signal for driving a pixel circuit. Since the output transistor in the GOA takes time to switch from on to off, the gate drive signal has a pulse edge of a certain width when it changes from the active level to the inactive level. For example, for a panel using a N-type thin film transistor (TFT) as a pixel transistor, there is a falling edge when the gate driver changes from a high level to a low level. The width of the falling edge is related to the properties of the output transistor itself. Due to the presence of this falling edge (that is, delay), the storage capacitor may leak and affect the display.

SUMMARY

The present disclosure proposes a data signal delay circuit, a delay method, and a display device.

According to an aspect of the present disclosure, there is provided a data signal delay circuit for a display panel comprising a feedback signal generation sub-circuit, a compensation signal generation sub-circuit, and a control sub-circuit. The feedback signal generation sub-circuit is electrically connected to a first level signal terminal, a second level signal terminal, scan signal lines connected to respective pixel rows of the display panel, and a first node. The feedback signal generation sub-circuit is configured to output a feedback signal at the first node based on a first level signal from the first level signal terminal and a second level signal from the second level signal terminal under the control of a gate drive signal from a scan signal line currently being scanned. The compensation signal generation sub-circuit is electrically connected to the first node, a data enable signal line, and a second node, and is configured to generate a compensation signal at the second node based on the feedback signal at the first node and a data enable signal from the data enable signal line. The control sub-circuit is electrically connected to the second node and the data enable signal line, and is configured to delay a data enable signal of the data enable signal line by a length of the active duration of the compensation signal in a next cycle based on the compensation signal at the second node.

In some embodiments, the feedback signal generation sub-circuit comprises a first transistor, a second transistor, a third transistor, and a first resistor. The first transistor has a control electrode electrically connected to the scan signal lines, a first electrode electrically connected to the first level signal terminal, and a second electrode electrically connected to a first end of the first resistor R1, the second transistor has a control electrode electrically connected to the scan signal lines, a first electrode electrically connected to the second level signal terminal, and a second electrode electrically connected to the first node, the third transistor has a control electrode electrically connected to the scan signal lines, a first electrode electrically connected to the second level signal terminal, and a second electrode electrically connected to the first node, a second end of the first resistor is electrically connected to the first node. The first transistor and the second transistor are the same type of transistor, the first transistor and the third transistor are different types of transistors, and a cutoff voltage of the first transistor and the third transistor is a cutoff voltage of a pixel transistor in a pixel circuit, a cutoff voltage of the second transistor is a minimum voltage at which the pixel transistor is fully turned on, wherein the pixel transistor is configured to control a data signal from a data signal line to charge a storage capacitor in the pixel circuit.

In some embodiments, the compensation signal generation sub-circuit comprises an exclusive OR gate and an AND gate. The exclusive OR gate has a first input terminal electrically connected to the first node, a second input terminal electrically connected to the data enable signal line, and an output terminal electrically connected to a first input terminal of the AND gate. The AND gate has a second input terminal electrically connected to the first node, and an output terminal electrically connected to the second node.

In some embodiments, the control sub-circuit comprises a compensation value counter and a phase adjuster. The compensation value counter is configured to determine a compensation value based on the length of the active duration of the compensation signal and to transmit the compensation value to the phase adjuster. The phase adjuster is configured to delay the data enable signal in the next cycle based on the compensation value.

In some embodiments, the control sub-circuit further comprises a flag bit generator configured to generate, based on the compensation signal, a flag bit "1" indicating that a delay is required or a flag bit "0" indicating that no delay is required, and the control sub-circuit is configured to disable the compensation value counter when the flag bit "0" is generated.

In some embodiments, the data signal delay circuit further comprises a decision sub-circuit, the decision sub-circuit being electrically connected to the data enable signal terminal, and configured to determine whether it currently corresponds to a rising or falling edge of the gate drive signal based on the data enable signal, and the data signal delay circuit disables the compensation signal generation sub-circuit in a case of the rising edge of the gate drive signal.

In some embodiments, the data enable signal is a data enable signal received from the data enable signal line in a cycle in a previous frame corresponding to the next cycle.

In some embodiments, the compensation value counter is a timer or a sampler.

In some embodiments, each of the scan signal lines extends from a first side of the display panel to a second side of the display panel in a direction in which the pixel rows extend, and a first end of each of the scan signal lines is electrically connected, on the first side, to a gate drive circuit for providing the gate drive signal. The feedback signal generation sub-circuit is configured to be electrically connected to each of the scan signal lines at the first end of the scan signal line, and is configured to receive a near-end gate drive signal at the first end to generate a first feedback signal.

In some embodiments, the display panel comprises a plurality of data enable signal lines, the plurality of data enable signal lines being used for controlling different data signal lines, respectively. The feedback signal generation sub-circuit is further configured to, instead of at the first end, be electrically connected to each of the scan signal lines at a second end of the scan signal line different from the first end, and is further configured to receive a far-end gate drive signal at the second end to generate a second feedback signal. The control sub-circuit is configured to apply different delays to the data enable signals of the plurality of data enable signal lines in the next cycle based on a first compensation signal obtained according to the first feedback signal and a second compensation signal obtained according to the second feedback signal.

According to another aspect of the present disclosure, there is provided a data signal delay method for a display panel. The method comprises: generating a feedback signal based on a gate drive signal from a scan signal line currently being scanned, wherein the feedback signal becomes a high level when the gate drive signal falls below a minimum voltage at which a pixel transistor in a pixel circuit is fully turned on, and the feedback signal becomes a low level when the gate drive signal falls below a cutoff voltage of the pixel transistor, wherein the pixel transistor is configured to control a data signal from a data signal line to charge a storage capacitor in the pixel circuit; generate a compensation signal based on the feedback signal and a data enable signal from the data enable signal line; and delaying a data enable signal of the data enable signal line by a length of the active duration of the compensation signal in a next cycle.

In some embodiments, the generating a feedback signal based on a gate drive signal from a scan signal line currently being scanned comprises: generating the feedback signal based on a first level signal from a first level signal terminal and a second level signal from a second level signal terminal under the control of the gate drive signal.

In some embodiments, the generating a compensation signal based on the feedback signal and a data enable signal from the data enable signal line comprises: performing an exclusive OR operation on the feedback signal and the data enable signal; and performing an AND operation on the feedback signal and the signal obtained by the exclusive OR operation to obtain the compensation signal.

In some embodiments, the delaying a data enable signal of the data enable signal line by a length of the active duration of the compensation signal in a next cycle comprises: determining a compensation value based on the length of the active duration of the compensation signal; and delaying the data enable signal in the next cycle based on the compensation value.

In some embodiments, the data enable signal is a data enable signal received from the data enable signal line in a cycle in a previous frame corresponding to the next cycle.

In some embodiments, the determining a compensation value based on the compensation signal comprises performing timing or high frequency sampling on the compensation signal.

In some embodiments, the display panel comprises a plurality of data enable signal lines, the plurality of data enable signal lines being used for controlling different data signal lines, respectively. The data signal delay method further comprises: generating another feedback signal based on a gate drive signal from a scan signal line currently being scanned, wherein the gate drive signal for generating the other feedback signal and the gate drive signal for generating the feedback signal are obtained at different positions of the scan signal line; obtaining another compensation signal based on the other feedback signal; applying different delays to the data enable signals of the plurality of data enable signal lines in the next cycle based on the compensation signal and the other compensation signal.

According to another aspect of the present disclosure, a display device is provided. The display device comprises the data signal delay circuit according to the above embodiments.

BRIEF DESCRIPTION OF THE DRAWINGS

In order to more clearly illustrate the technical solutions in the embodiments of the present disclosure or the prior art, the drawings to be used in the description of the embodiments will be briefly described below. It is apparent that the drawings in the following description illustrate merely some embodiments of the present disclosure, and other drawings may be obtained by those skilled in the art based on the drawings without creative efforts.

DETAILED DESCRIPTION

Figure 1:
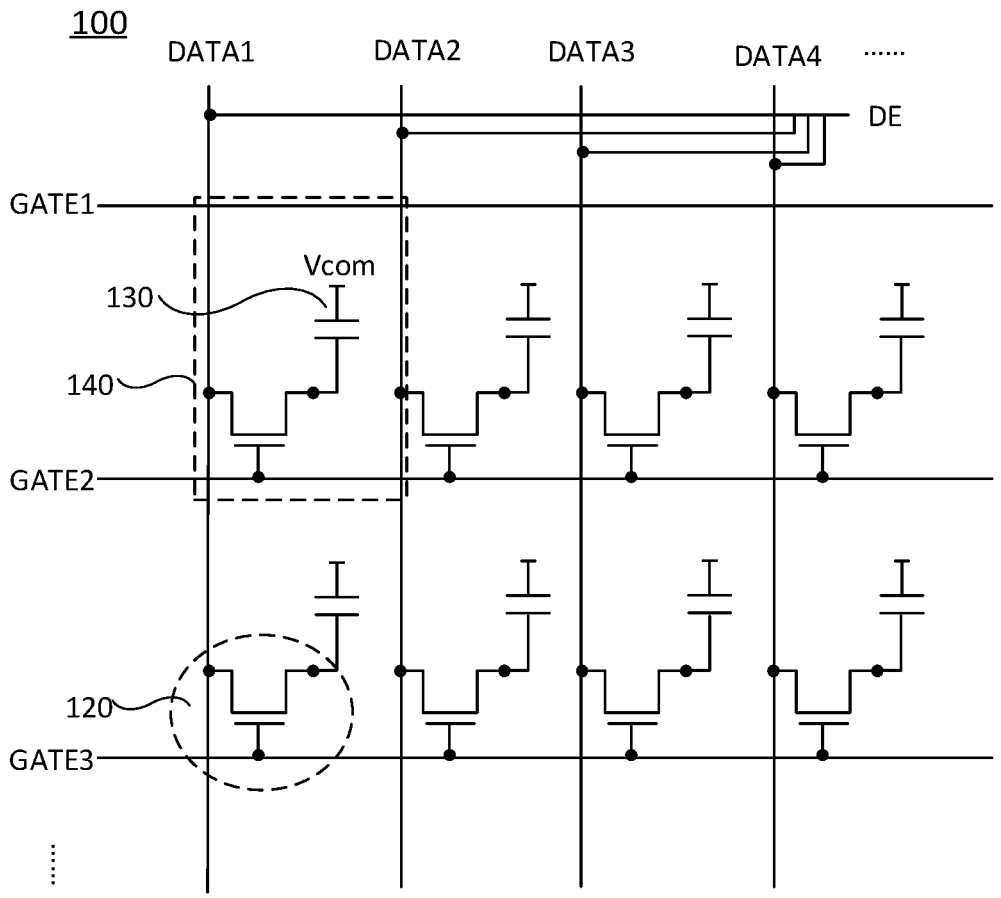
FIG. 1 shows a schematic circuit diagram of a pixel circuit.

In order to make the purpose, technical solutions and advantages of the embodiments of the present disclosure more clear, the technical solutions in the embodiments of the present disclosure will be clearly and completely described below in conjunction with the drawings in the embodiments of the present disclosure. It is apparent that the described embodiments are part and not all of the embodiments of the present disclosure. All other embodiments obtained by a person of ordinary skill in the art based on the described embodiments of the present disclosure without creative efforts should fall within the protection scope of the present disclosure. It should be noted that the same elements are denoted by the same or similar reference numerals throughout the drawings. In the following description, some specific embodiments are for illustrative purposes only, and should not be understood as limiting the present disclosure, but are only examples of embodiments of the present disclosure. Conventional structures or configurations will be omitted when they may cause confusion to the understanding of the present disclosure. It should be noted that the shapes and sizes of the various components in the drawings do not reflect the true size and proportions, but merely illustrate the contents of the embodiments of the present disclosure.

Technical or scientific terms used in the embodiments of the present disclosure should be of ordinary meaning as understood by those skilled in the art, unless otherwise defined. The terms “first”, “second” and similar words used in the embodiments of the present disclosure do not denote any order, quantity, or importance, but are merely used to distinguish different components.

In addition, in the description of the embodiments of the present disclosure, the term "connected" or "electrically connected" may mean that two components are directly connected or electrically connected, or that two components are connected or electrically connected via one or more other components. In addition, the two components may be electrically connected or electrically coupled in a wired or wireless manner. Hereinafter, when "A and B are connected" is mentioned, both the case where "A and B are electrically connected" and the case where "A and B are connected by other means" are included.

The transistors used in the embodiments of the present disclosure may each be a thin film transistor or a field effect transistor or other devices having the same characteristics. The transistors used in the embodiments of the present disclosure are mainly switching transistors in accordance with their roles in the circuit. Since the source and drain of the thin film transistor used herein are symmetrical, the source and the drain thereof may be interchangeable. In the embodiments of the present disclosure, one of the source and the drain is referred to as the first electrode, and the other of the source and the drain is referred to as the second electrode. In the following examples, the first transistor T1 and the second transistor T2 are exemplified as N-type thin film transistors, and the third transistor T3 is exemplified as a P-type thin film transistor. Those skilled in the art may understand that in other embodiments, the first transistor T1 and the second transistor T2 may also be exemplified as a P-type thin film transistor, and the third transistor T3 may also be exemplified as an N-type thin film transistor.

Further, in the description of the embodiments of the present disclosure, the terms "active level" and "inactive level" are respective levels at which the relevant transistors are fully turned on and completely cut off. Hereinafter, for the case where an N-type thin film transistor is taken as an example, the "active level" is a high level, and the "inactive level" is a low level, and for the case where a P-type thin film transistor is taken as an example, the "active level" is a low level, and the "inactive level" is a high level. Hereinafter, the "cutoff voltage" of a transistor refers to the maximum voltage (for an N-type transistor) or the minimum voltage (for a P-type transistor) that causes the transistor to be in a completely cutoff state.

The present disclosure is specifically described below with reference to the accompanying drawings.

Figure 2:
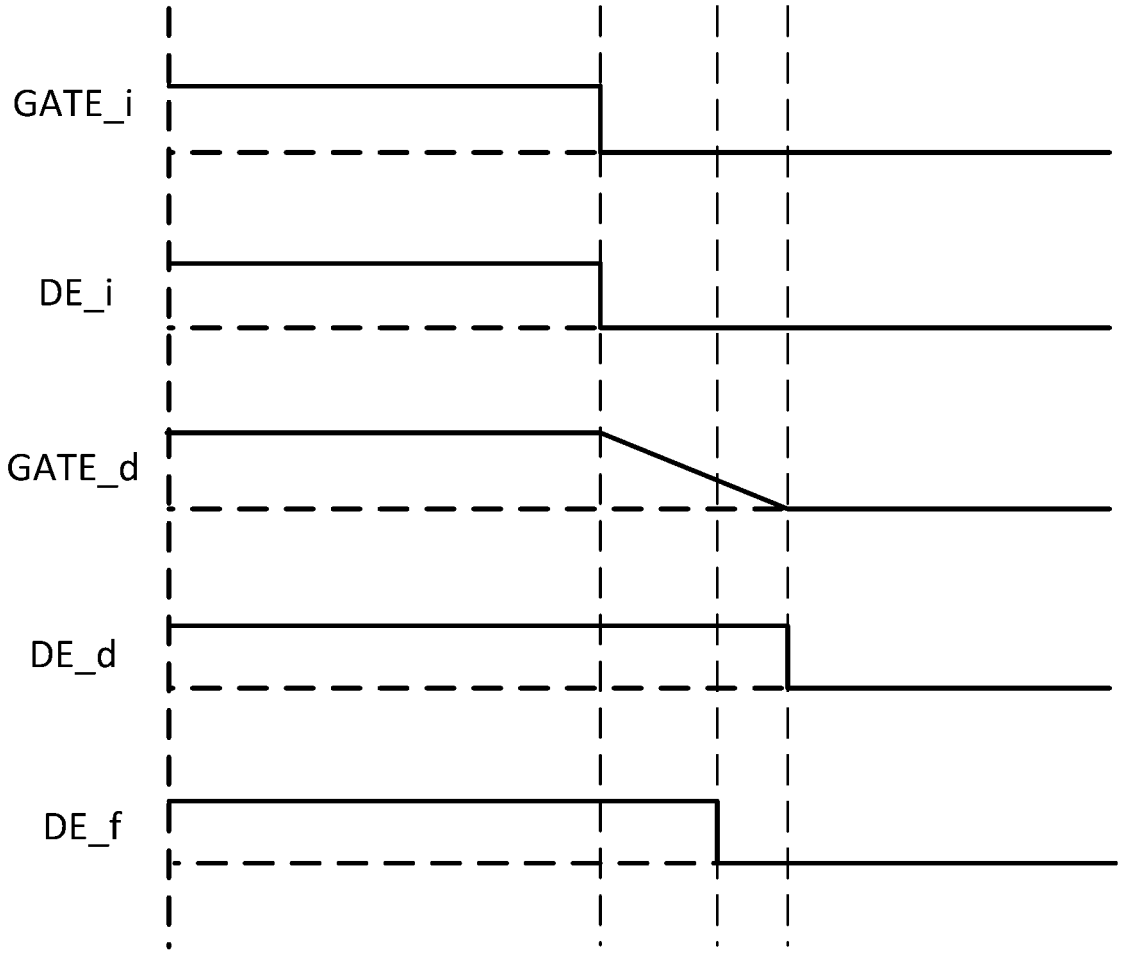
FIG. 2 shows a timing diagram including a gate drive signal and a data enable signal.

FIG. 1 shows a schematic circuit diagram of a pixel circuit 100. FIG. 2 shows a timing diagram including a gate drive signal and a data enable signal.

As shown in FIG. 1, the pixel circuit 100 includes a plurality of pixels 140 arranged in an array, each of which is connected to a scan signal line GATE (for example, GATE2) and a data signal line DATA (for example, DATA1). A pixel transistor 120 and a storage capacitor 130 are included in each of the pixels 140. The pixel transistor 120 has a control electrode connected to the scan signal line, a first electrode connected to the data signal line, and a second electrode connected to a first end of the storage capacitor 130. A second end of the storage capacitor 130 is connected to the common electrode Vcom.

The pixel transistor 120 may be turned on under the control of the gate drive signal from the scan signal line, thereby enabling the data signal from the data signal line to charge the storage capacitor 130 to a predetermined voltage. The transmission of the data signal is controlled by a data enable signal from the data enable signal line (DE), and when the data enable signal is at a high level, the data signal can be transmitted to the pixel circuit.

Ideally, when the charge is completed, and before the data signal of the data signal line changes under the control of the data enable signal (for example, the level drops to or becomes zero), the gate drive signal of the scan signal line changes directly from a high level to a low level, so that the pixel transistor 120 is turned off and the charge of the storage capacitor 130 is stopped. The storage capacitor 130 is maintained at a predetermined voltage. For example, as shown by GATE_i and DE_i in FIG. 2, the gate drive signal from GATE_i and the data enable signal from DE_i simultaneously change from a high level to a low level to achieve the pixel charge control in an ideal situation.

In the actual case, due to the presence of the delay described above, there is a falling edge of the gate drive signal on the scan signal line. Therefore, the same delay is required for the data enable signal so that the data enable signal changes at or after the end of the falling edge of the gate drive signal to achieve an ideal pixel charge control. For example, as shown by GATE_d and DE_d in FIG. 2, the signals from GATE_d and DE_d are delayed results of signals from GATE_i and DE_i, respectively, and the pixel charge control in an ideal situation can also be achieved.

However, since the transistors are different between the shift registers corresponding to the respective scan signal lines, the delays corresponding to the gate drive signals from the respective scan signal lines are different. If a consistent delay is applied to the data enable signal, for some transistors, there may be a case in which the data enable signal has become zero so that the data signal stops charging the storage capacitor before the gate drive signal completely decreases from a high level to a low level. In this case, the storage capacitor that has been charged to the predetermined voltage may leak. For example, as shown by GATE_d and DE_f in FIG. 2, the signals from GATE_d and DE_f are delayed results of signals from GATE_i and DE_i, respectively, however, the delay of the data enable signal is less than the delay of the gate drive signal, which cannot achieve the pixel charge control in an ideal situation.

To this end, the present disclosure proposes a data signal delay circuit and a delay method capable of more optimized delay of the data enable signal.

Figure 3:
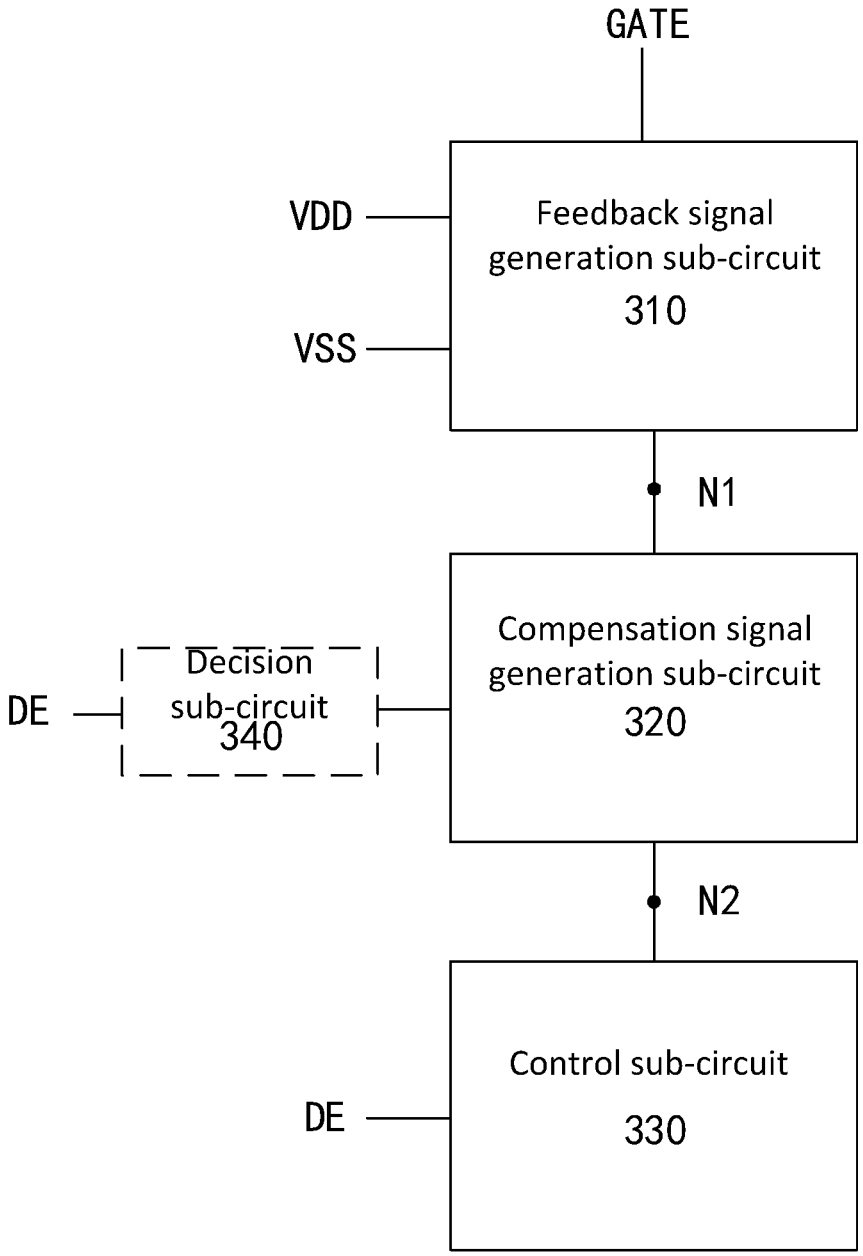
FIG. 3 shows a schematic block diagram of a data signal delay circuit in accordance with an embodiment of the present disclosure.

FIG. 3 shows a schematic block diagram of a data signal delay circuit 300 in accordance with an embodiment of the present disclosure.

As shown in FIG. 3, the data signal delay circuit 300 includes a feedback signal generation sub-circuit 310, a compensation signal generation sub-circuit 320, and a control sub-circuit 330. The feedback signal generation sub-circuit 310 and the compensation signal generation sub-circuit 320 are connected to each other at the first node N1, and the compensation signal generation sub-circuit 320 and the control sub-circuit 330 are connected to each other at the second node N2.

The feedback signal generation sub-circuit 310 is electrically connected to a first level signal terminal VDD, a second level signal terminal VSS, scan signal lines GATE (for example, GATE1, GATE2, GATE3, etc. as shown in FIG. 1) connected to respective pixel rows of the display panel, and the first node N1. The feedback signal generation sub-circuit 310 is configured to output a feedback signal FB at the first node N1 based on a first level signal from the first level signal terminal VDD and a second level signal from the second level signal terminal VSS under the control of the gate drive signal from a scan signal line GATE.

In some embodiments, each of the scan signal lines extends, from a first side of the display panel (for example, a side adjacent to the GOA) to a second side of the display panel (for example, a side remote from the GOA), in a direction in which the rows of pixels extend. A first end of each of the scan signal lines is electrically connected to the GOA on the first side. The feedback signal generation sub-circuit 310 is electrically connected to each of the scan signal lines at the first end of the scan signal line, and is configured to receive the near-end gate drive signal at the first end to output a first feedback signal.

It should be understood that the GATE herein does not specifically represent a certain scan signal line, but is used to indicate that the signal received by the feedback signal generation sub-circuit 310 is a signal from the scan signal line currently being scanned. In some embodiments, the feedback signal generation sub-circuit 310 is connected to all of the scan signal lines of the display panel. Since the progressive scanning is employed, the feedback signal generation sub-circuit 310 sequentially receives the gate drive signals from the respective scan signal lines. The reception of the gate drive signal by the feedback signal generation sub-circuit 310 is synchronized with the reception of the gate drive signal by the pixel circuit. Each time the feedback signal generation sub-circuit 310 receives a gate drive signal from a scan signal line, it operates to derive the compensation signal according to the gate drive signal from the scan signal line. Since the difference in delay between adjacent gate drive signals is small, the data enable signal can be more optimally delayed by using the derived delay when the gate drive signal of the next scan signal line drives the pixel circuit.

The compensation signal generation sub-circuit 320 is electrically connected to the first node N1, the data enable signal line DE, and the second node N2. The compensation signal generation sub-circuit 320 is configured to generate a compensation signal Comp at the second node N2 based on the feedback signal FB from the first node N1 and the data enable signal DE_r from the data enable signal line DE.

In some embodiments, the data enable signal line DE is used to control all data signal lines. In other embodiments, different data signal lines are controlled by different data enable signal lines DEs, respectively. FIG. 1 shows an example where one data enable signal line DE controls all data signal lines.

In some embodiments, the data enable signal DE_r may be a data enable signal received from the data enable signal line DE in a cycle in the previous frame corresponding to the next cycle.

The control sub-circuit 330 is electrically connected to the second node N2 and the data enable signal line DE. The control sub-circuit 330 is configured to delay the data enable signal of the data enable signal line DE by a length of an active duration of the compensation signal Comp in the next cycle based on the compensation signal Comp at the second node N2.

In some embodiments, data signal delay circuit 300 further includes a decision sub-circuit 340. The decision sub-circuit 340 is connected to the data enable signal terminal DE, and is configured to determine whether it currently corresponds to the rising or falling edge of the gate drive signal based on the data enable signal. The data enable signal changing from the inactive level to the active level corresponds to the rising edge of the gate drive signal, and the data enable signal changing from the active level to the inactive level corresponds to the falling edge of the gate drive signal. The data signal delay circuit 300 is configured to disable the compensation signal generation sub-circuit 320 in the case of the rising edge of the gate drive signal. That is, the compensation signal generation sub-circuit 320 and the control sub-circuit 330 operate only in the case of the falling edge of the gate drive signal.

Figure 4:
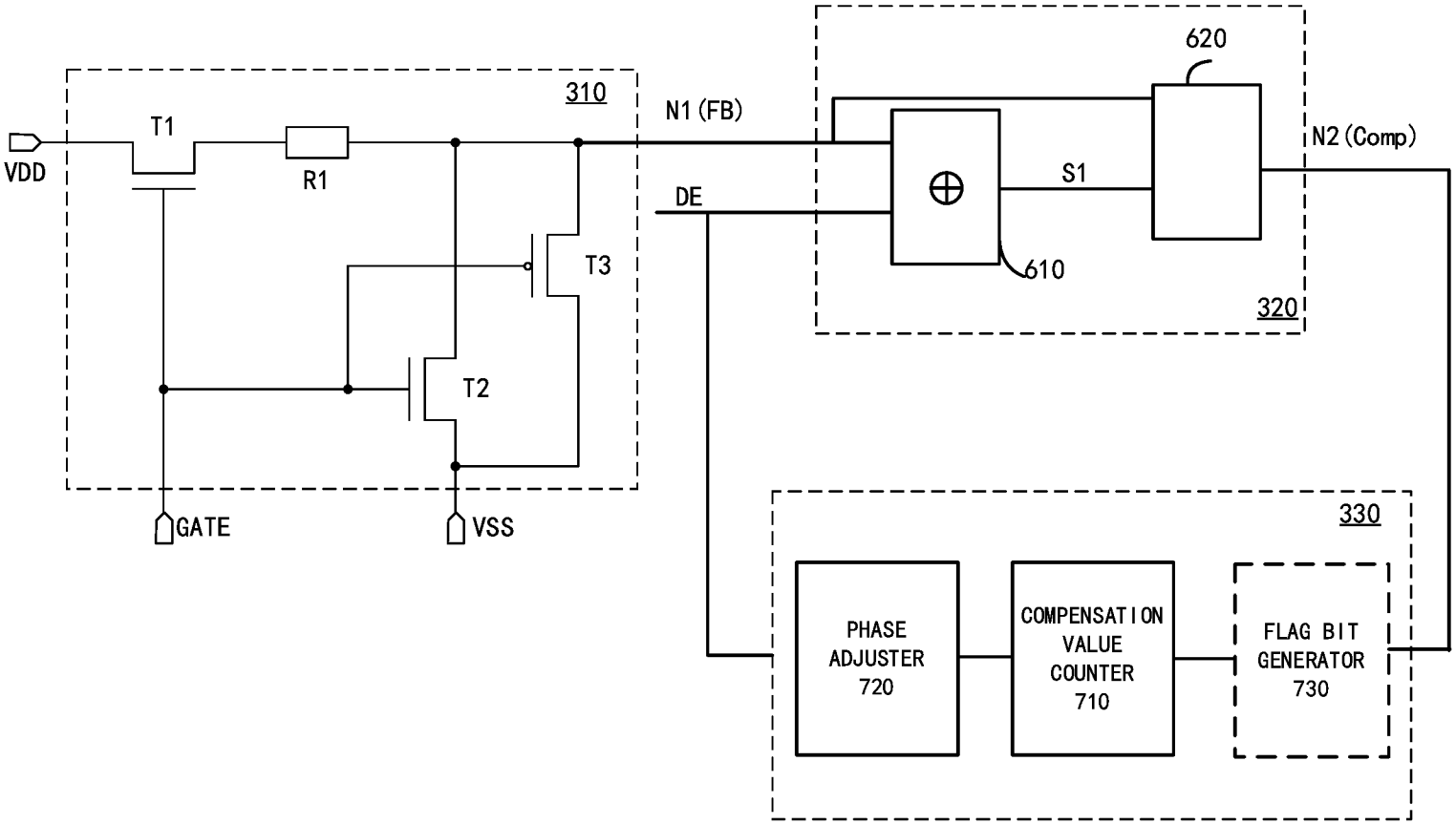
FIG. 4 shows a schematic block diagram of the data signal delay circuit of FIG. 3.

FIG. 4 shows a schematic circuit diagram of the data signal delay circuit 300 of FIG. 3.

As shown in FIG. 4, the feedback signal generation sub-circuit 310 includes a first transistor T1, a second transistor T2, a third transistor T3, and a first resistor R1. The first transistor T1 and the second transistor are N-type thin film transistors, and the third transistor T3 is a P-type thin film transistor.

The first transistor T1 has a control electrode electrically connected to the scan signal lines GATE, a first electrode electrically connected to the first level signal terminal VDD, and a second electrode electrically connected to a first end of the first resistor R1.

The second transistor T2 has a control electrode electrically connected to the scan signal lines GATE, a first electrode electrically connected to the second level signal terminal VSS, and a second electrode electrically connected to the first node N1. In some embodiments, the second level signal terminal VSS may be the ground voltage GND (that is, zero volts), and the case where the second level signal terminal is the ground voltage GND is described below as an example.

The third transistor T3 has the same connection relationship as the second transistor T2, and has a control electrode electrically connected to the scan signal lines GATE, a first electrode electrically connected to the second level signal terminal VSS, and a second electrode electrically connected to the first node N1.

A second end of the first resistor R1 is electrically connected to the first node N1.

As shown in FIG. 4, the compensation signal generation sub-circuit 320 includes an exclusive OR gate 610 and an AND gate 620.

The first input terminal of the exclusive OR gate 610 is electrically connected to the first node N1, the second input terminal of the exclusive OR gate 610 is electrically connected to the data enable signal line DE, and the output terminal of the exclusive OR gate 610 is electrically connected to the first input terminal of the AND gate 620.

The second input terminal of the AND gate 620 is electrically connected to the first node N1, and the output terminal of the AND gate 620 is electrically connected to the second node N2.

As shown in FIG. 4, the control sub-circuit 330 includes a compensation value counter 710 and a phase adjuster 720.

The compensation value counter 710 is connected to the second node N2, and configured to determine a compensation value based on a length of the active duration of the compensation signal Comp at the second node N2 and to transmit the compensation value to the phase adjuster 720. As described above, in some embodiments, the compensation value is the duration of the high level period of the compensation signal Comp.

In some embodiments, the compensation value counter 710 may be a timer. For example, the compensation value counter 710 may trigger the timer when the rising edge of the compensation signal Comp arrives, and stop the timer when the falling edge of the compensation signal arrives, thereby obtaining the duration of the high level period of the compensation signal Comp.

In other embodiments, the compensation value counter 710 may be a sampler. For example, the compensation signal Comp may be continuously sampled by high frequency sampling pulses, and the duration of the high level period of the compensation signal Comp may be calculated by the sampling count value and the width of the sampling pulse.

The phase adjuster 720 is connected to the output of the compensation value counter 710 and the data enable signal line DE, and configured to delay the data enable signal on the data enable signal line DE in the next cycle based on the compensation value from the compensation value counter 710.

In some embodiments, the control sub-circuit 330 may further include a flag bit generator 730. The flag bit generator 730 is configured to generate, based on the compensation signal Comp, a flag bit "1" indicating that a delay is required or a flag bit "0" indicating that no delay is required. The control sub-circuit 330 is configured to disable the compensation value counter 710 when the flag bit "0" is generated, that is, the compensation value counter 710 and phase adjuster 720 do not operate when the flag bit "0" is generated.

Figure 5:
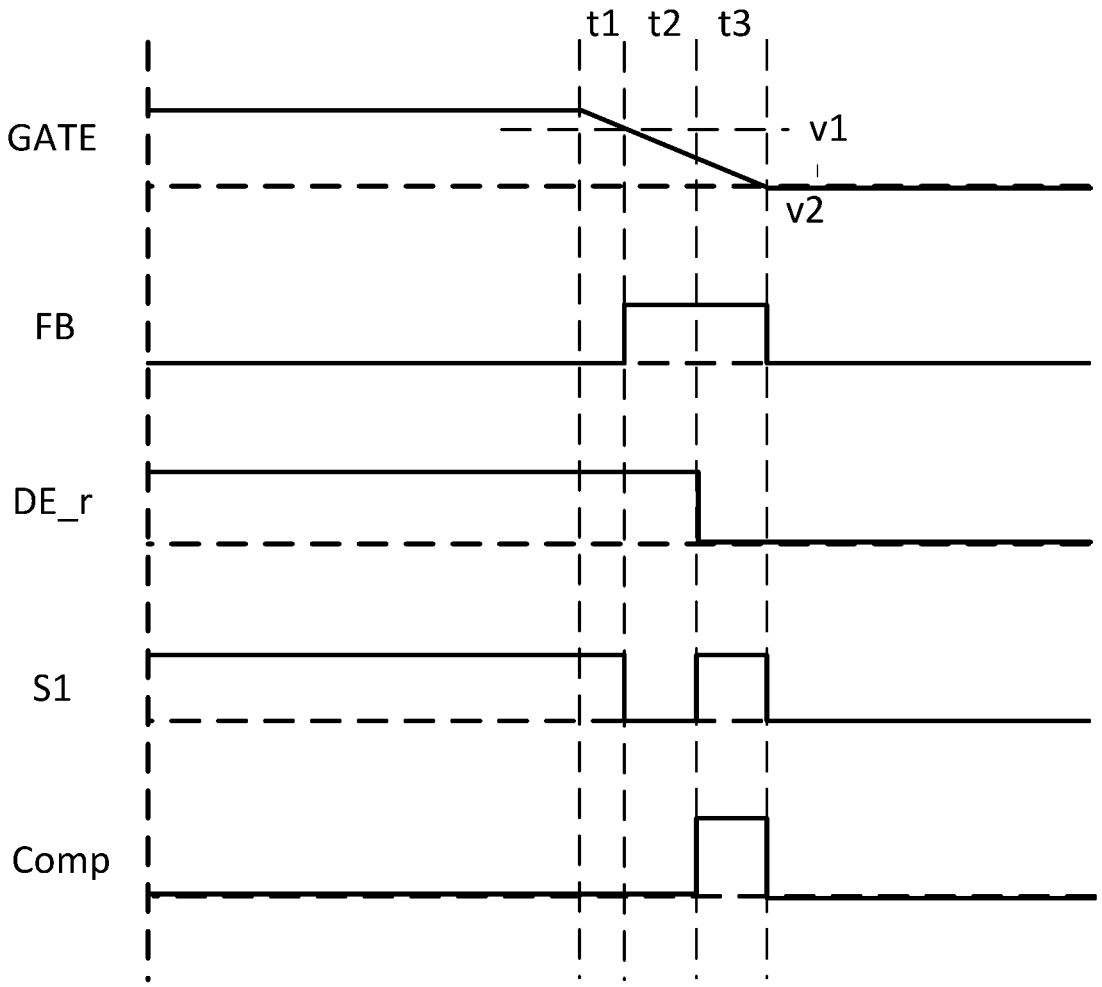
FIG. 5 shows a signal timing diagram of the data signal delay circuit of FIG. 4.

FIG. 5 shows a signal timing diagram of the data signal delay circuit of FIG. 4. The state of the data signal delay circuit will be described in details below in conjunction with FIG. 5.

The cutoff voltage of the second transistor T2 of the feedback signal generation sub-circuit 310 shown in FIG. 4 is the minimum voltage v1 at which the pixel transistors in the pixel circuit are fully turned on (see v1 shown in FIG. 5), the cutoff voltage of the first transistor T1 is the cutoff voltage v2 of the pixel transistors (see v2 shown in FIG. 4), and the cutoff voltage of the third transistor T3 is the cutoff voltage v2 of the pixel transistors.

Referring to the timing diagram in FIG. 5, during the t1 period, the gate drive signal falls from its high level, but is still higher than v1, so that the pixel transistors in the currently driven pixel row can be turned on. The data enable signal DE_r has a high level.

The voltages of the control electrodes of the N-type transistors T1 and T2 are higher than their respective cut-off voltages, and both T1 and T2 are turned on; the voltage of the control electrode of the P-type transistor T3 is higher than the cut-off voltage thereof, and T3 is turned off. At this time, the voltage of the feedback signal FB output to the node N1 is the ground voltage GND (in fact, the voltage of the feedback signal FB is at a low level very close to the ground voltage GND, which is approximated to the ground voltage for convenience of explanation).

The feedback signal FB output to the node N1 has a low level (for example, zero volts), and the data enable signal DE_r has a high level. The result S1 obtained by the exclusive OR operation of the feedback signal FB and the data enable signal DE_r at the exclusive OR gate 610 has a high level. The result S1 and the feedback signal FB are further operated by the AND gate 620, and the obtained compensation signal Comp has a low level. That is, the compensation signal Comp output at the node N2 has a low level during the t1 period.

During the t2 period, the voltage of the gate drive signal is less than v1 but greater than v2, that is, less than the cutoff voltage of T2, but greater than the cutoff voltage of T1. Thus, T2 becomes the off state, T1 is still on, and T3 is still off. At this time, the voltage of the feedback signal FB output at the node N1 is a high level voltage from VDD.

The feedback signal FB has a high level, and the data enable signal DE_r has a high level. The result S1 obtained by the exclusive OR operation of the feedback signal FB and the data enable signal DE_r at the exclusive OR gate 610 has a low level. The result S1 and the feedback signal FB are further operated by the AND gate 620, and the obtained compensation signal Comp has a low level. That is, the compensation signal Comp output at the node N2 has a low level during the t2 period.

During the t3 period, the voltage of the gate drive signal is less than v1 but greater than v2, that is, less than the cutoff voltage of T2, but greater than the cutoff voltage of T1. Thus, T2 becomes the off state, T1 is still on, and T3 is still off. At this time, the voltage of the feedback signal FB is a high level voltage from VDD.

The feedback signal FB has a high level, and the data enable signal DE_r has a low level. The result S1 obtained by the exclusive OR operation of the feedback signal FB and the data enable signal DE_r at the exclusive OR gate 610 has a high level. The result S1 and the feedback signal FB are further operated by the AND gate 620, and the obtained compensation signal Comp has a high level. That is, the compensation signal Comp output at the node N2 has a high level during the t3 period.

After the t3 period, the voltage of the gate drive signal is less than v2. Both T1 and T2 become off and T3 begins to turn on. At this time, the ground voltage GND from VSS is transmitted to the node N1 through T3, and the voltage of the feedback signal FB output at the node N1 is the ground voltage.

The feedback signal FB has a low level, and the data enable signal DE_r has a low level. The result S1 obtained by the exclusive OR operation of the feedback signal FB and the data enable signal DE_r at the exclusive OR gate 610 has a low level. The result S1 and the feedback signal FB are further operated by the AND gate 620, and the obtained compensation signal Comp has a low level after the t3 period.

Thereby, the voltage of the feedback signal FB output at the node N1 is at a high level for a period of t2+t3.

The compensation signal Comp generated by the compensation signal generation sub-circuit 320 has a high level only during the t3 period. As can be seen from FIG. 5, the t3 period corresponds to the length of time for which the data enable signal DE_r (for example, the data enable signal in the cycle in the previous frame corresponding to the next cycle) needs to be delayed. Therefore, it is only necessary to measure or calculate the high level duration of the compensation signal Comp to make a more optimized delay of the data enable signal in the next cycle.

It is to be noted that the division of the t2 and t3 periods shown in FIG. 5 is based on the time point at which the data enable signal DE_r changes from a high level to a low level. However, this is only illustrative. The data enable signal DE_r may change from a high level to a low level at any time point before the gate drive signal decreases completely from a high level to a low level. As described above in connection with FIG. 2, when the gate driving signal and the data enable signal simultaneously change from the high level to the low level, the pixel charge control in an ideal situation is achieved. Thus, if the data enable signal DE_r is delayed to change from the high level to the low level until the gate drive signal decreases completely from the high level to the low level, the pixel charge control in the ideal situation is achieved.

It can also be seen from the above embodiment that the generated compensation signal Comp has a high level only during the t3 period, thereby the data enable signal and the gate drive signal simultaneously change from a high level to a low level by delaying the data enable signal by a length of the active duration of the compensation signal Comp (i.e., the high level duration) in the next cycle.

Figure 6:
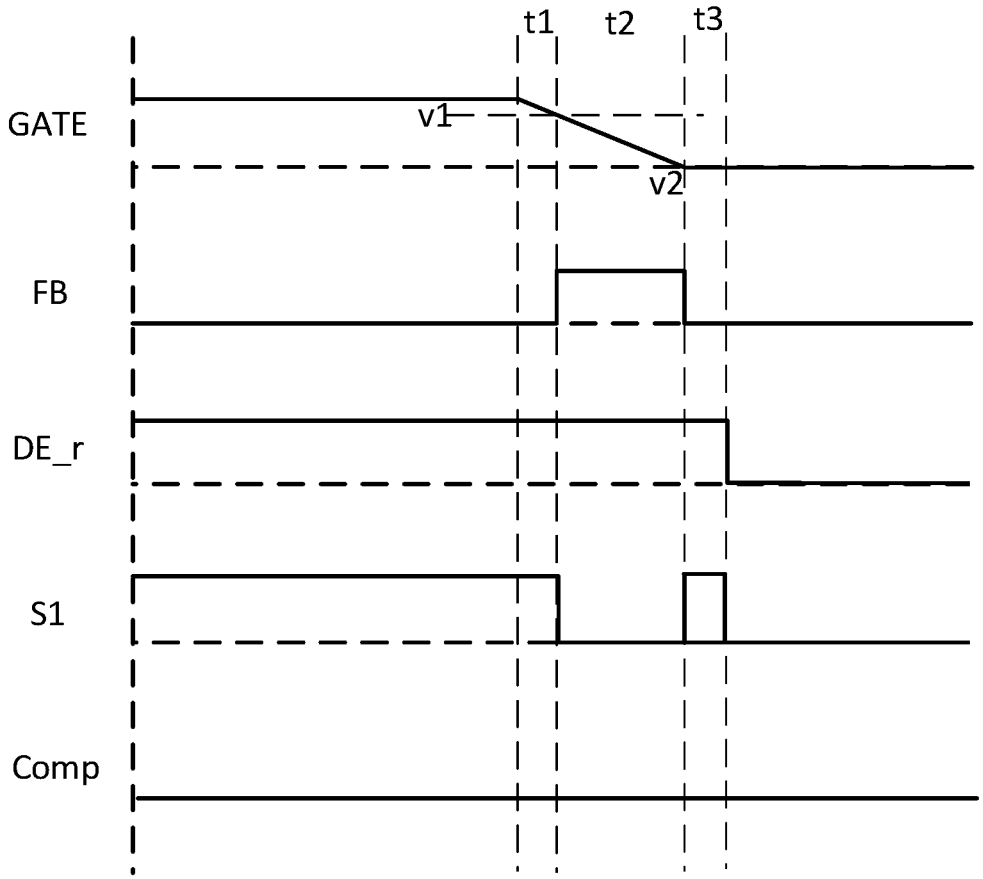
FIG. 6 shows another signal timing diagram of the data signal delay circuit of FIG. 4.

FIG. 6 shows another signal timing diagram of the data signal delay circuit of FIG. 4. The state of the data signal delay circuit will be described in details below in conjunction with FIG. 6.

The difference between FIG. 6 and FIG. 5 is that the data enable signal DE_r changes from a high level to a low level when the gate drive signal has completely decreased from a high level to a low level.

Referring to the timing diagram in FIG. 6, during the t1 period, the gate drive signal falls from its high level, but is still higher than v1, so that the pixel transistors in the currently driven pixel row can be turned on. The data enable signal DE_r has a high level.

The voltages of the control electrodes of the N-type transistors T1 and T2 are higher than their respective cut-off voltages, and both T1 and T2 are turned on; the voltage of the control electrode of the P-type transistor T3 is higher than the cut-off voltage thereof, and T3 is turned off. At this time, the voltage of the feedback signal FB output to the node N1 is the ground voltage GND (in fact, the voltage of the feedback signal FB is at a low level very close to the ground voltage GND, which is approximated to the ground voltage for convenience of explanation).

The feedback signal FB output to the node N1 has a low level (for example, zero volts), and the data enable signal DE_r has a high level. The result S1 obtained by the exclusive OR operation of the feedback signal FB and the data enable signal DE_r at the exclusive OR gate 610 has a high level. The result S1 and the feedback signal FB are further operated by the AND gate 620, and the obtained compensation signal Comp has a low level. That is, the compensation signal Comp output at the node N2 has a low level during the t1 period.

During the t2 period, the voltage of the gate drive signal is less than v1 but greater than v2, that is, less than the cutoff voltage of T2, but greater than the cutoff voltage of T1. Thus, T2 becomes the off state, T1 is still on, and T3 is still off. At this time, the voltage of the feedback signal FB output at the node N1 is a high level voltage from VDD.

The feedback signal FB has a high level, and the data enable signal DE_r has a high level. The result S1 obtained by the exclusive OR operation of the feedback signal FB and the data enable signal DE_r at the exclusive OR gate 610 has a low level. The result S1 and the feedback signal FB are further operated by the AND gate 620, and the obtained compensation signal Comp has a low level. That is, the compensation signal Comp output at the node N2 has a low level during the t2 period.

During the t3 period, the voltage of the gate drive signal is less than v2. Both T1 and T2 become off and T3 begins to turn on. At this time, the ground voltage GND from VSS is transmitted to the node N1 through T3, and the voltage of the feedback signal FB output at the node N1 is the ground voltage.

The feedback signal FB has a low level, and the data enable signal DE_r has a high level. The result S1 obtained by the exclusive OR operation of the feedback signal FB and the data enable signal DE_r at the exclusive OR gate 610 has a high level. The result S1 and the feedback signal FB are further operated by the AND gate 620, and the obtained compensation signal Comp has a low level during the t3 period.

After the t3 period, the voltage of the gate drive signal is less than v2. Both T1 and T2 become off and T3 begins to turn on. At this time, the ground voltage GND from VSS is transmitted to the node N1 through T3, and the voltage of the feedback signal FB output at the node N1 is the ground voltage.

The feedback signal FB has a low level, and the data enable signal DE_r has a low level. The result S1 obtained by the exclusive OR operation of the feedback signal FB and the data enable signal DE_r at the exclusive OR gate 610 has a low level. The result S1 and the feedback signal FB are further operated by the AND gate 620, and the obtained compensation signal Comp has a low level after the t3 period.

Thereby, the voltage of the feedback signal FB output at the node N1 is at a high level for a period of t2.

The compensation signal Comp generated by the compensation signal generation sub-circuit 320 maintains the low level all the time. That is, there is no need to delay the data enable signal of the next cycle.

In the embodiment, the flag bit generator 730 can be configured to always maintain a low level based on the compensation signal Comp, and generate a flag bit "0" indicating that no delay is required, thereby disabling the compensation value counter 710 and the phase adjuster 720.

Comparing FIG. 5 and FIG. 6, it can be seen that the data signal delay circuit according to the present embodiment can determine the length of time that the data enable signal DE_r needs to be delayed with respect to the gate drive circuit.

In the embodiment described above with reference to FIGS. 3 to 6, by extracting the gate drive signal of the scan signal line being scanned during each cycle, the delay that should be applied to the data enable signal when the next scan signal line is scanned is calculated adaptively.

Here, the calculated delay is the same for each pixel in the same row that is simultaneously scanned. However, as the gate drive signal propagates on the scan signal line, each pixel in the same pixel row requires a different delay due to the presence of the RC delay.

With this in mind, in the case where different data signal lines are controlled by different data enable signals DEs, respectively, the feedback signal generation sub-circuit 310 in FIG. 3 may be further electrically connected to the scan signal lines at the second end (for example, located on the side away from the GOA) of the scan signal lines. Thus, the feedback signal generation sub-circuit 310 may receive the far-end gate drive signal at the second end to generate a second feedback signal.

Thus, according to the above, two different feedback signals may be obtained from the near-end gate drive signal and the far-end gate drive signal, and then two different compensation signals may be obtained. The control sub-circuit 330 may apply different delays to the data enable signals of the different data enable signal lines in the next cycle based on the two compensation signals.

For example, different compensation values Ca and Cb may be obtained from two different compensation signals. In one embodiment, the RC delay may be considered to increase linearly with the extension of the scan signal line. In the case where N pixels are included in each pixel row, the compensation value to be applied to the data enable signal line for controlling the supply of data signals to the nth pixel should be:

$$Ca+(n-1)/(N-1)\times(Cb-Ca).$$

It should be understood that at least a portion of the data signal delay circuit 300 of the present disclosure may be implemented by a timing controller or integrated in a timing controller. For example, the control sub-circuit 330 may be a portion of a timing controller.

Figure 7:
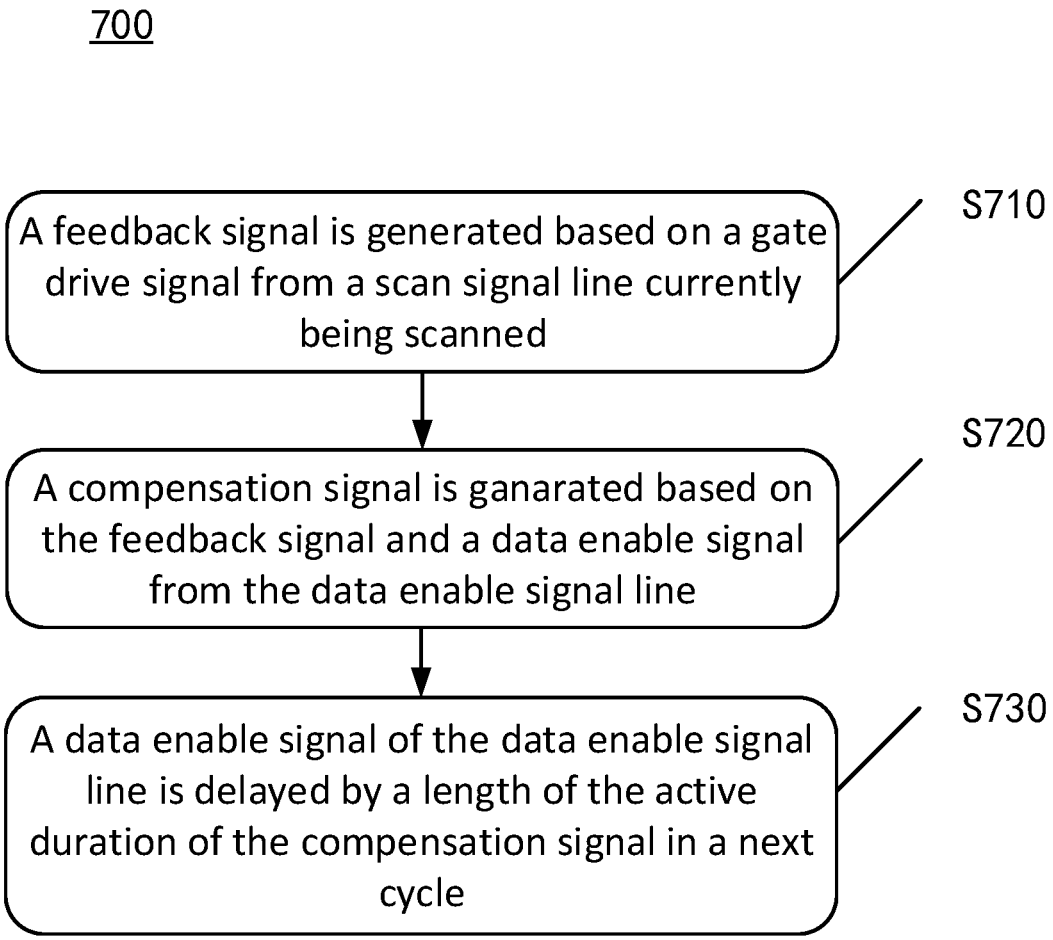
FIG. 7 shows a flow chart of a data signal delay method in accordance with an embodiment of the present disclosure.

FIG. 7 shows a flow chart of a data signal delay method 700 in accordance with an embodiment of the present disclosure. The data signal delay method 700 may be implemented by the data signal delay circuit 300 in accordance with the above embodiments. Therefore, the interpretation and description of the data signal delay circuit 300 above is equally applicable here.

In step S710, a feedback signal is generated based on a gate drive signal from a scan signal line currently being scanned.

The feedback signal becomes a high level when the gate drive signal falls below a minimum voltage at which a pixel transistor in a pixel circuit is fully turned on, and the feedback signal becomes a low level when the gate drive signal falls below a cutoff voltage of the pixel transistor.

In some embodiments, in step S710, the feedback signal is generated based on a first level signal from a first level signal terminal and a second level signal from a second level signal terminal under the control of the gate drive signal.

In step S720, a compensation signal is generated based on the feedback signal and a data enable signal from the data enable signal line.

In some embodiments, in step S720, an exclusive OR operation is first performed on the feedback signal and the data enable signal, and then an AND operation is performed on the feedback signal and the signal obtained by the exclusive OR operation to obtain the compensation signal.

In step S730, a data enable signal of the data enable signal line is delayed by a length of the active duration of the compensation signal in a next cycle.

In some embodiments, in step S730, a compensation value is first determined based on the length of the active duration of the compensation signal, and then the data enable signal is delayed in a next cycle based on the compensation value.

In some embodiments, the display panel includes a plurality of data enable signal lines, the plurality of data enable signal lines being used for controlling different data signal lines, respectively. In this case, the method 700 may further comprise:

generating another feedback signal based on a gate drive signal from a scan signal line currently being scanned, wherein the gate drive signal for generating the other feedback signal and the gate drive signal for generating the feedback signal are obtained at different positions of the scan signal line;

obtaining another compensation signal based on the other feedback signal; and applying different delays to the data enable signals of the plurality of data enable signal lines in the next cycle based on the compensation signal and the other compensation signal.

Figure 8:
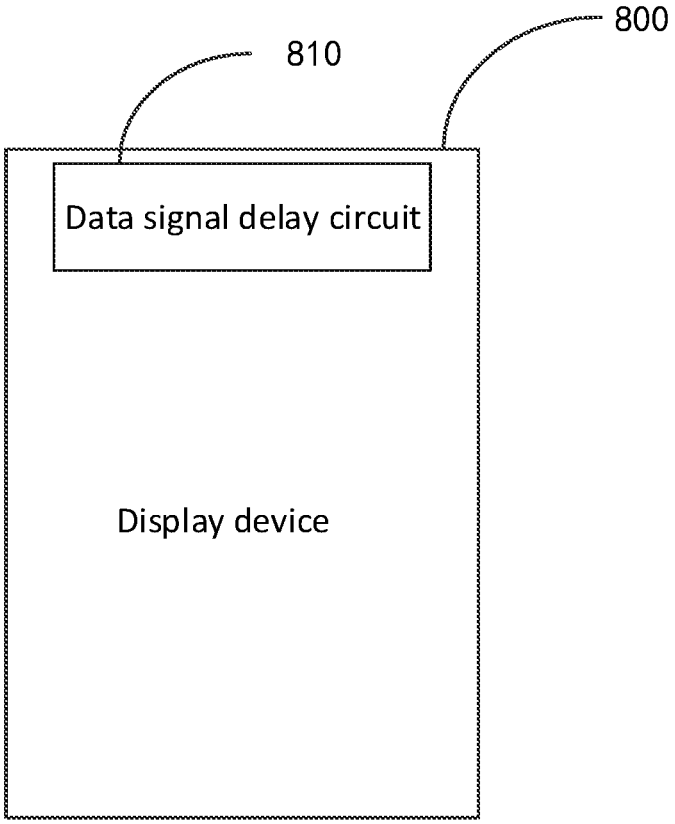
FIG. 8 shows a schematic diagram of a display device in accordance with an embodiment of the present disclosure.

FIG. 8 shows a schematic block diagram of a display device in accordance with an embodiment of the present disclosure. As shown in FIG. 8, the display device 800 includes a data signal delay circuit 810. The data signal delay circuit 810 may be implemented by a data signal delay circuit according to any of the embodiments of the present disclosure. The display device 800 according to an embodiment of the present disclosure may be any product or component having a display function such as an electronic paper, a mobile phone, a tablet computer, a television, a display, a notebook computer, a digital photo frame, a navigator, or the like.

The detailed description above has set forth numerous embodiments by using the schematic diagrams, flow diagrams and/or examples. In the event that such schematics, flowcharts, and/or examples include one or more functions and/or operations, those skilled in the art will appreciate that each function and/or operation in such a schematic, flowchart, or example may be implemented individually and/or collectively by various structures, hardware, software, firmware or virtually any combination thereof.

Although the present disclosure has been described with reference to several typical embodiments, it should be understood that the terminology used is illustrative and exemplary, and not for limiting the scope. Since the present disclosure may be embodied in a variety of forms without departing from the spirit or scope of the disclosure, it should be understood that the above-described embodiments are not limited to the details of the foregoing, but should be construed broadly within the spirit and scope defined by the appended claims, so that all changes and modifications that come within the scope of the claims or the equivalents thereof are intended to be covered by the appended claims.

We claim:

1. A data signal delay circuit for a display panel, comprising a feedback signal generation sub-circuit, a compensation signal generation sub-circuit, and a control sub-circuit, wherein:

the feedback signal generation sub-circuit is electrically connected to a first level signal terminal, a second level signal terminal, scan signal lines connected to respective pixel rows of the display panel, and a first node, and the feedback signal generation sub-circuit is configured to output a feedback signal at the first node based on a first level signal from the first level signal terminal and a second level signal from the second level signal terminal under the control of a gate drive signal from a scan signal line currently being scanned;

the compensation signal generation sub-circuit is electrically connected to the first node, a data enable signal line, and a second node, and is configured to output a compensation signal at the second node based on the feedback signal at the first node and a data enable signal from the data enable signal line; and the control sub-circuit is electrically connected to the second node and the data enable signal line, and is configured to delay a data enable signal of the data enable signal line by a length of the active duration of the compensation signal in a next cycle based on the compensation signal at the second node.

2. The data signal delay circuit of claim 1, wherein the feedback signal generation sub-circuit comprises a first transistor, a second transistor, a third transistor, and a first resistor, and wherein:

the first transistor has a control electrode electrically connected to the scan signal lines, a first electrode electrically connected to the first level signal terminal, and a second electrode electrically connected to a first end of the first resistor R1;

the second transistor has a control electrode electrically connected to the scan signal lines, a first electrode electrically connected to the second level signal terminal, and a second electrode electrically connected to the first node;

the third transistor has a control electrode electrically connected to the scan signal lines, a first electrode electrically connected to the second level signal terminal, and a second electrode electrically connected to the first node, and a second end of the first resistor is electrically connected to the first node;

wherein the first transistor and the second transistor are the same type of transistor, the first transistor and the third transistor are different types of transistors, and a cutoff voltage of the first transistor and the third transistor is a cutoff voltage of a pixel transistor in a pixel circuit, a cutoff voltage of the second transistor is a minimum voltage at which the pixel transistor is fully turned on, wherein the pixel transistor is configured to control a data signal from a data signal line to charge a storage capacitor in the pixel circuit.

3. The data signal delay circuit of claim 1, wherein the compensation signal generation sub-circuit comprises an exclusive OR gate and an AND gate, and wherein:

the exclusive OR gate has a first input terminal electrically connected to the first node, a second input terminal electrically connected to the data enable signal line, and an output terminal electrically connected to a first input terminal of the AND gate; and the AND gate has a second input terminal electrically connected to the first node, and an output terminal electrically connected to the second node.

4. The data signal delay circuit of claim 1, wherein the control sub-circuit comprises a compensation value counter and a phase adjuster, and wherein:

the compensation value counter is configured to determine a compensation value based on the length of the active duration of the compensation signal and to transmit the compensation value to the phase adjuster; and the phase adjuster is configured to delay the data enable signal in the next cycle based on the compensation value.

5. The data signal delay circuit of claim 4, wherein the control sub-circuit further comprises a flag bit generator configured to generate, based on the compensation signal, a flag bit "1" indicating that a delay is required or a flag bit "0" indicating that no delay is required, and wherein:

the control sub-circuit is configured to disable the compensation value counter when the flag bit "0" is generated.

6. The data signal delay circuit of claim 1, further comprising a decision sub-circuit, the decision sub-circuit being electrically connected to the data enable signal terminal, and configured to determine whether it currently corresponds to a rising or falling edge of the gate drive signal based on the data enable signal, and wherein:

the data signal delay circuit disables the compensation signal generation sub-circuit in a case of the rising edge of the gate drive signal.

7. The data signal delay circuit of claim 1, wherein the data enable signal is a data enable signal received from the data enable signal line in a cycle in a previous frame corresponding to the next cycle.

8. The data signal delay circuit of claim 4, wherein the compensation value counter is a timer or a sampler.

9. The data signal delay circuit of claim 1, wherein each of the scan signal lines extends from a first side of the display panel to a second side of the display panel in a direction in which the pixel rows extend, and a first end of each of the scan signal lines is electrically connected, on the first side, to a gate drive circuit for providing the gate drive signal, and wherein:

the feedback signal generation sub-circuit is configured to be electrically connected to each of the scan signal lines at the first end of the scan signal line, and is configured to receive a near-end gate drive signal at the first end to generate a first feedback signal.

10. The data signal delay circuit of claim 9, wherein the display panel comprises a plurality of data enable signal lines, the plurality of data enable signal lines being used for controlling different data signal lines, respectively, and wherein:

the feedback signal generation sub-circuit is further configured to, instead of at the first end, be electrically connected to each of the scan signal lines at a second end of the scan signal line different from the first end, and is further configured to receive a far-end gate drive signal at the second end to generate a second feedback signal; and the control sub-circuit is configured to apply different delays to the data enable signals of the plurality of data enable signal lines in the next cycle based on a first compensation signal obtained according to the first feedback signal and a second compensation signal obtained according to the second feedback signal.

11. A data signal delay method for a display panel, comprising:

generating a feedback signal based on a gate drive signal from a scan signal line currently being scanned, wherein the feedback signal becomes a high level when the gate drive signal falls below a minimum voltage at which a pixel transistor in a pixel circuit is fully turned on, and the feedback signal becomes a low level when the gate drive signal falls below a cutoff voltage of the pixel transistor, wherein the pixel transistor is configured to control a data signal from a data signal line to charge a storage capacitor in the pixel circuit;

generating a compensation signal based on the feedback signal and a data enable signal from the data enable signal line; and delaying a data enable signal of the data enable signal line by a length of the active duration of the compensation signal in a next cycle.

12. The data signal delay method of claim 11, wherein the generating a feedback signal based on a gate drive signal from a scan signal line currently being scanned comprises:

generating the feedback signal based on a first level signal from a first level signal terminal and a second level signal from a second level signal terminal under the control of the gate drive signal.

13. The data signal delay method of claim 11, wherein the generating a compensation signal based on the feedback signal and a data enable signal from the data enable signal line comprises:

performing an exclusive OR operation on the feedback signal and the data enable signal; and performing an AND operation on the feedback signal and the signal obtained by the exclusive OR operation to obtain the compensation signal.

14. The data signal delay method of claim 11, wherein the delaying a data enable signal of the data enable signal line by a length of the active duration of the compensation signal in a next cycle comprises:

determining a compensation value based on the length of the active duration of the compensation signal; and delaying the data enable signal in the next cycle based on the compensation value.

15. The data signal delay method of claim 11, wherein the data enable signal is a data enable signal received from the data enable signal line in a cycle in a previous frame corresponding to the next cycle.

16. The data signal delay circuit of claim 14, wherein the determining a compensation value based on the compensation signal comprises performing timing or high frequency sampling on the compensation signal.

17. The data signal delay method of claim 11, wherein the display panel comprises a plurality of data enable signal lines, the plurality of data enable signal lines being used for controlling different data signal lines, respectively, and wherein the data signal delay method further comprises:

generating another feedback signal based on a gate drive signal from a scan signal line currently being scanned, wherein the gate drive signal for generating the other feedback signal and the gate drive signal for generating the feedback signal are obtained at different positions of the scan signal line;

obtaining another compensation signal based on the other feedback signal; and applying different delays to the data enable signals of the plurality of data enable signal lines in the next cycle based on the compensation signal and the other compensation signal.

18. A display device comprising the data signal delay circuit of claim 1.

* * * * *